US008460066B2

(12) United States Patent
Araki et al.

(10) Patent No.: US 8,460,066 B2
(45) Date of Patent: Jun. 11, 2013

(54) GRINDING MACHINE

(75) Inventors: Yoshiaki Araki, Nanto (JP); Takashi Imai, Nanto (JP)

(73) Assignee: Komatsu NTC Ltd. (JP)

( * ) Notice: Subject to any disclaimer, the term of this patent is extended or adjusted under 35 U.S.C. 154(b) by 0 days.

(21) Appl. No.: 13/581,500

(22) PCT Filed: May 9, 2011

(86) PCT No.: PCT/JP2011/060669

§ 371 (c)(1),
(2), (4) Date: Aug. 28, 2012

(87) PCT Pub. No.: WO2011/142323

PCT Pub. Date: Nov. 17, 2011

(65) Prior Publication Data

US 2013/0045666 A1 Feb. 21, 2013

(30) Foreign Application Priority Data

May 11, 2010 (JP) ..... 2010-109404

(51) Int. Cl.
*B24B 5/00* (2006.01)

(52) U.S. Cl.
USPC ..... 451/242; 451/246; 451/251; 451/451

(58) Field of Classification Search
USPC ..... 451/178, 242, 246, 249, 251, 451, 451/10, 11
See application file for complete search history.

(56) References Cited

U.S. PATENT DOCUMENTS 5,577,952 A * 11/1996 Naumann et al. ..... 451/51
5,738,564 A * 4/1998 Helle et al. ..... 451/11
6,733,371 B2 * 5/2004 Giebmanns ..... 451/65
6,958,006 B2 * 10/2005 Wakazono ..... 451/65
8,133,098 B2 * 3/2012 Makiuchi et al. ..... 451/127
2002/0090898 A1 * 7/2002 Giebmanns ..... 451/65
2002/0164222 A1 * 11/2002 Sato et al. ..... 409/137
2005/0020197 A1 * 1/2005 Wakazono ..... 451/451
2009/0148082 A1 * 6/2009 Makiuchi et al. ..... 384/13

FOREIGN PATENT DOCUMENTS

JP 2003-094277 A 4/2003
JP 2006-297510 A 11/2006
JP 3923769 B2 6/2007

* cited by examiner

*Primary Examiner* — Eileen P. Morgan
(74) *Attorney, Agent, or Firm* — Fox Rothschild LLP

(57) ABSTRACT

A grinding machine includes a pair of workpiece support devices (12, 13), which clamp and rotate a workpiece (W), on a bed (11). A pair of saddles (14) is provided on the bed (11) in such a way as to be movable along the rotational axis of the workpiece (W). Grindstone heads (16) provided with rotating grindstones (16*c*) and drive mechanisms (16*d*) are supported on the saddles (14) in such a way as to be movable in a direction that perpendicularly intersects the movement direction of the saddles (14). There is provided a partition structure (20) which consists of a fixed cover (21) and a extendable cover (22), and serves to partition a machining region (T) for the purpose of sealing off the same so that the clamping portions (12*a*, 13*a*) and the rotating grindstones (16*c*) of both of the workpiece support devices (12, 13) will be located inside the machining region (T), and that bearing sections (12*b*, 13*b*) and driving sections (12*c*, 13*c*) of both of the workpiece support devices (12, 13), as well as bearing sections (16*b*) and driving sections (16*d*) of both of the grindstone heads (16), will be located outside the machining region (T).

6 Claims, 7 Drawing Sheets

GRINDING MACHINE

FIELD OF THE INVENTION

The present invention relates to a grinding machine that simultaneously grinds two parts of a workpiece such as a crankshaft of an internal combustion engine with a pair of grindstones.

BACKGROUND OF THE INVENTION

In this kind of grinding machines, a pair of workpiece support devices is generally provided on a bed. The pair of workpiece support devices clamp a workpiece on both ends of the workpiece and rotate the workpiece about a horizontal axis. A pair of saddles is arranged on the bed to be movable along the rotation axis of the workpiece. A grinding head is supported on each of the saddles to be movable in the direction perpendicular to the moving direction of the saddle. Each grinding head includes a grindstone and a drive mechanism that drives the grindstone. The grindstones are arranged corresponding to predetermined sections to be machined of the workpiece by movement of the saddles. While the grindstones are rotated in this state, the grinding heads are moved toward the rotating workpiece. Accordingly, the sections to be machined of the workpiece are ground.

In the grinding machine formed as described above, a large amount of coolant is constantly supplied to the sections to be machined of the workpiece ground by the grindstones.

Therefore, coolant or coolant mist including swarf might be scattered from the sections to be machined to the surrounding area of the machine. In the conventional grinding machine, the entire machine is covered by a cover to prevent scattering of coolant.

The structure disclosed in, for example, Patent Document 1 has also been proposed as a cover structure for a single-head grinding machine including one grindstone. In the conventional structure, a machining region including the grindstones is covered by a cover device formed of an extendable cover including a telescopic cover and a bellows cover, and a fixed cover.

PRIOR ART DOCUMENT

Patent Document

Patent Document 1: Japanese Patent No. 3923769

SUMMARY OF THE INVENTION

However, the conventional structure has the following drawbacks.

In the conventional structure in which the entire machine of the grinding machine is covered by the cover, coolant is prevented from scattering to the outside of the machine. However, coolant scattered to the surrounding area from the section to be machined of the workpiece might collect on the bearing portion and the drive mechanism of the grinding head or the bearing portions of the workpiece support devices. This might cause troubles.

Also, in the conventional structure disclosed in Patent Document 1, the structure of the cover is for a single-head grinding machine, which includes one grindstone. Therefore, it is difficult to apply the cover structure disclosed in Patent Document 1 to a grinding machine including two grinding heads.

Furthermore, in the grinding machine of Patent Document 1, the telescopic cover and the bellows cover extend and contract as the grinding head reciprocates along the left and right direction. The grinding head partitioned by a wiper of a slide gate that moves in synchronization with the motion in the left and right direction can move forward and backward in the direction toward the workpiece. However, in the grinding machine including two grinding heads, the distance between the grinding heads changes from ten-odd millimeters to over 1000 mm, and the motions of the grinding heads in the front and rear direction with respect to the workpiece might not synchronize with each other. Thus, it is difficult to construct a scattering prevention mechanism for coolant between the grinding heads.

Accordingly, it is an objective of the present invention to provide a grinding machine that prevents scattering of a coolant and a coolant mist from a machining region by sealing the machining region including grindstones of a pair of grinding heads.

In accordance with one aspect of the present invention, a grinding machine that grinds, in a machining region, a workpiece having ends is provided. The grinding machine includes a bed, a pair of workpiece support devices, a pair of first saddles, a pair of second saddles, and a pair of grinding heads. The workpiece support devices are located on the bed. Each workpiece support device includes a clamping portion, a bearing section, and a driving section. The workpiece support devices rotate the workpiece about a horizontal axis in a state where the workpiece is clamped by the clamping portions on both ends of the workpiece. The first saddles are movable in a first direction, which extends along a rotation axis of the workpiece. The second saddles are respectively attached to the pair of first saddles, the second saddles being movable in a second direction, which is orthogonal to the first direction. The grinding heads are respectively located on the pair of second saddles. Each grinding head includes a grindstone, a bearing section, and a drive mechanism. The grinding machine further includes partitioning means for partitioning the machining region to be sealed such that the clamping portions of the pair of workpiece support devices and the grindstones of the pair of grinding heads are arranged inside the machining region, and the bearing sections and the driving sections of the pair of workpiece support devices and the bearing sections and the drive mechanisms of the pair of grinding heads are arranged outside the machining region.

The partitioning means preferably includes a fixed cover fixed to the bed and an extendable cover attached between the fixed cover and the pair of first saddles, between the first saddles and the second saddles, and between the pair of first saddles. The extendable cover selectively extends and contracts in accordance with the movement of the pair of first saddles and the pair of second saddles.

The fixed cover preferably includes a pair of first fixed covers and a pair of second fixed covers. The first fixed covers are formed on and orthogonal to the bed. Each first fixed cover shields between the clamping portion and the bearing section of the corresponding workpiece support device, between the bearing section of the corresponding workpiece support device and the corresponding grinding head, and the outward part of the corresponding grinding head in the first direction. The second fixed covers are fixed on the second saddles. Each second fixed cover shields the bearing section and the drive mechanism of the corresponding grindstone from the grindstone.

The grinding machine preferably includes a pair of first support columns and a pair of second support columns. The first support columns are each formed on and orthogonal to a rear upper surface of one of the first saddles. The second support columns are each formed on and orthogonal to the upper surface of one of first saddles. The extendable cover preferably includes a first extendable cover, a pair of second extendable covers, and a pair of third extendable covers. The first extendable cover shields between the pair of first support columns. The second extendable covers each shields between a shield portion of one of the first fixed covers on the outer section in the first direction and the corresponding one of second support columns. The third extendable covers each shields between one of the first support columns and the rear edge of the corresponding second fixed cover.

The first to third extendable covers are preferably formed of bellows covers.

A gap is preferably formed between each second support column and a shield portion of the corresponding second fixed cover on the outer section in the first direction. The each second support column is provided with a sealing member. Each sealing member shields one of the gaps and slidably contacting the outer surface of the associated shield portion.

A third fixed cover is preferably attached to the associated first and second support columns to be located above each of the pair of second fixed covers. Each third fixed cover is provided with first and second horizontal sealing members. The first and second horizontal sealing members shield a gap between each second fixed cover and the associated third fixed cover. The first and second horizontal sealing members can slidably contact the upper surface of a horizontal shield portion of the associated second fixed cover. A fourth fixed cover is attached to the upper edges of the first fixed covers, the upper edge of each of the first to third extendable covers, and the upper surface of the corresponding third fixed cover, the fourth fixed cover shielding the upper space of the machining region.

In the grinding machine of the present invention, only the machining region including the grindstones of the pair of grinding heads can be partitioned by partitioning means, and effectively closed. Therefore, when grinding the workpiece, coolant and coolant mist are prevented from scattering from the machining region to the surrounding area.

EFFECTS OF THE INVENTION

According to the present invention, coolant and coolant mist are prevented from scattering from a machining region to the surrounding area by sealing the machining region including grindstones of a pair of grinding heads.

DETAILED DESCRIPTION OF THE PREFERRED EMBODIMENTS

A grinding machine according to one embodiment of the present invention will now be described with reference to FIGS. 1 to 7.

Figure 1:
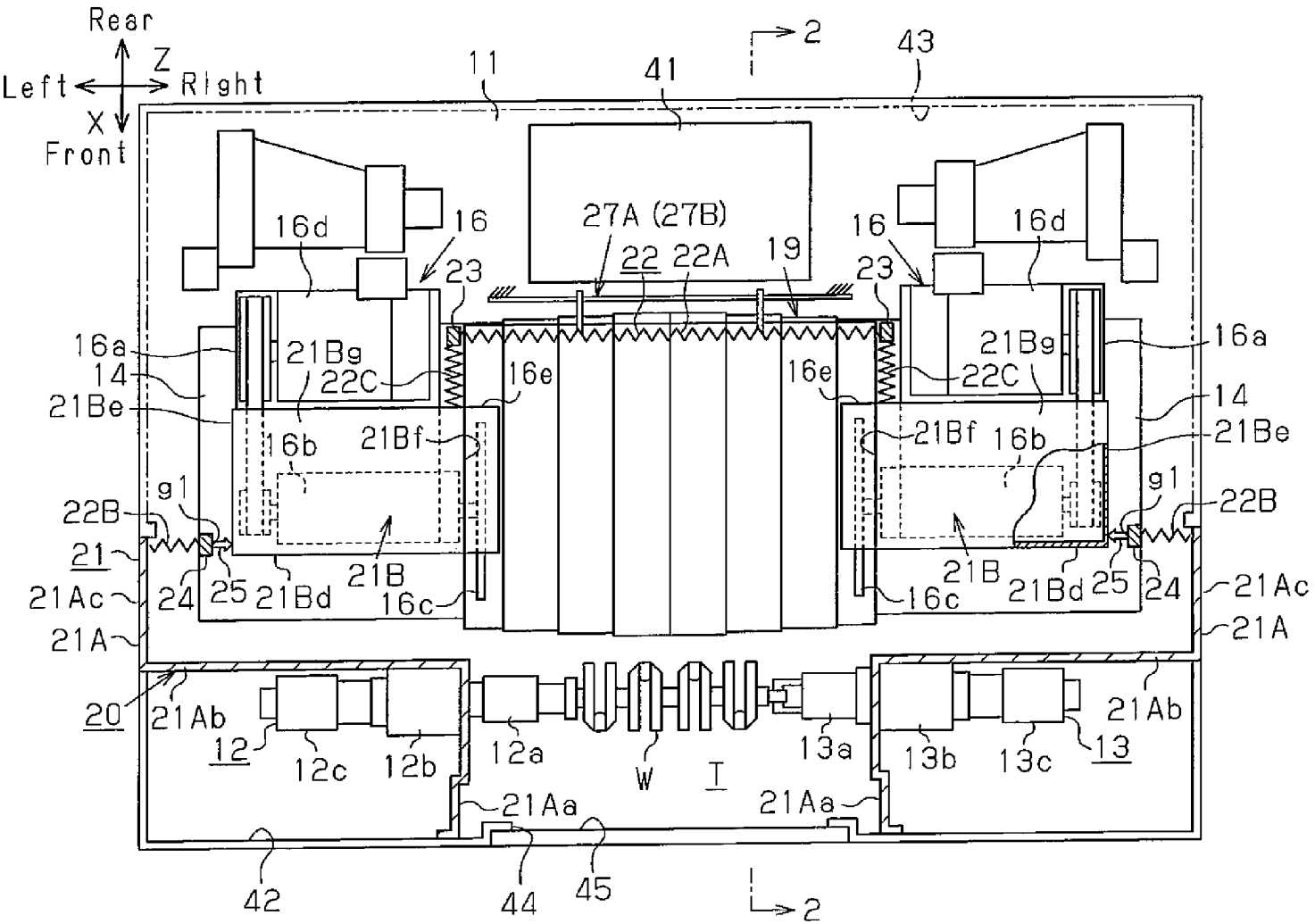
FIG. 1 is a cross-sectional plan view illustrating a grinding machine according to one embodiment of the present invention.

As shown in FIG. 1, a pair of workpiece support devices 12, 13 is arranged on a front upper surface of a bed 11. The workpiece support devices 12, 13 are formed of a headstock and a tailstock and are arranged to face each other with a gap formed in between. The workpiece support devices 12, 13 respectively include clamping portions 12*a*, 13*a*, which clamp a workpiece W such as a crankshaft at both ends of the workpiece W, bearing sections 12*b*, 13*b*, which rotatably support the clamping portions 12*a*, 13*a*, and driving sections 12*c*, 13*c* such as motors for rotating the clamping portions 12*a*, 13*a*. Also, the workpiece support devices 12, 13 can adjust the clamping positions in accordance with the workpiece W. In a state where the workpiece W is clamped between the clamping portions 12*a*, 13*a* of the workpiece support devices 12, 13, the driving sections 12*c*, 13*c* rotate the workpiece W about the horizontal axis, which extends in a first direction, which is a Z-axis (left and right in FIG. 1) direction in this embodiment.

Figure 2:
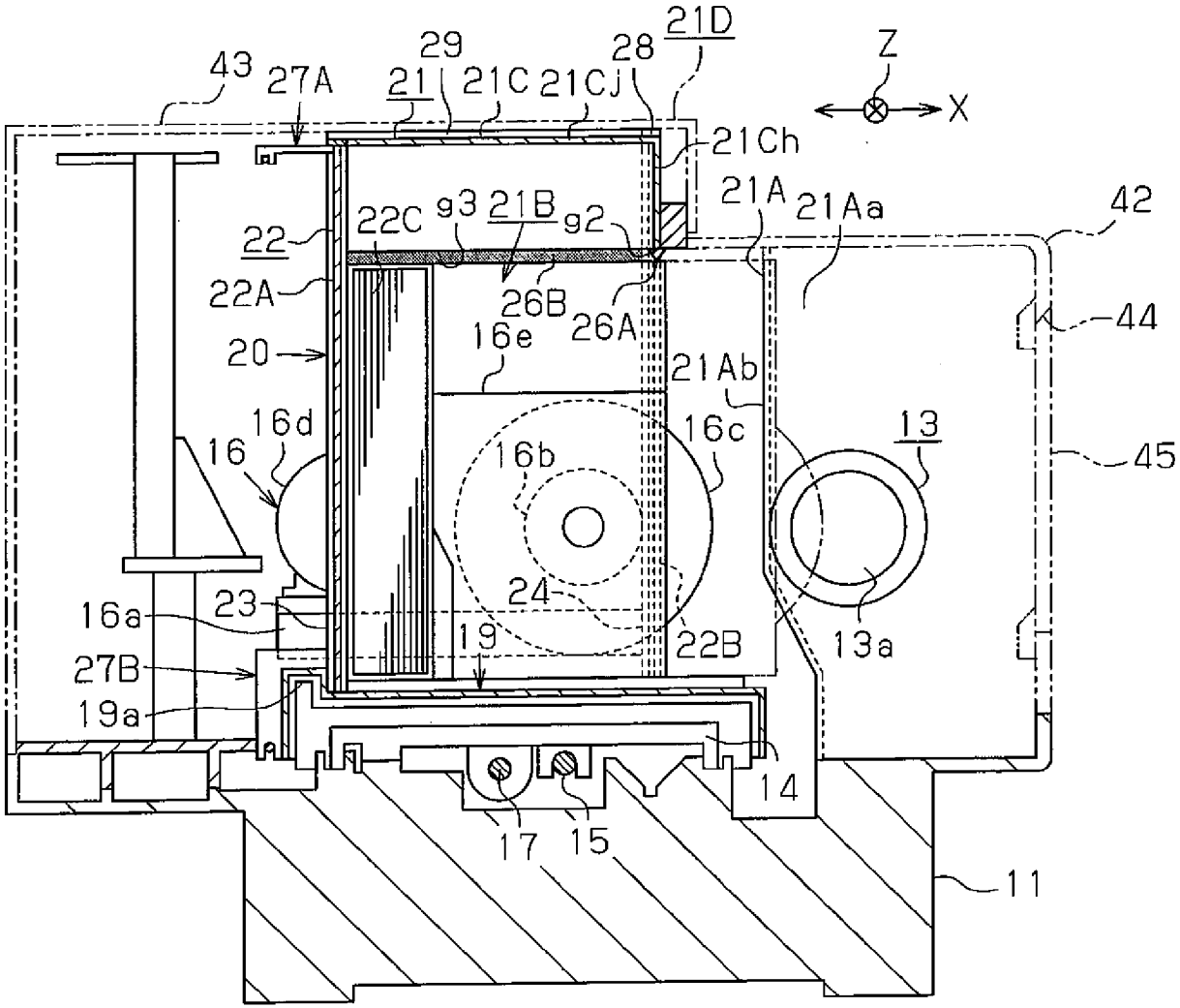
FIG. 2 is a cross-sectional view taken along line 2-2 of FIG. 1.

As shown in FIGS. 1 and 2, a first saddle, which is a pair of Z-axis saddles 14 in this embodiment, is arranged at the rear of the workpiece support devices 12, 13 on the upper surface of the bed 11. The Z-axis saddles 14 are movable along the rotation axis of the workpiece W, which is the Z-axis direction, via a guide rod 15. A grinding head 16 is supported on each Z-axis saddle 14 to be movable in a second direction, which is an X-axis (front and rear) direction orthogonal to the moving direction of the Z-axis saddles 14. That is, each grinding head 16 includes a second saddle, which is an X-axis saddle 16*a* in this embodiment, a grindstone 16*c*, a drive mechanism 16*d*, and a grindstone cover 16*e*. Each X-axis saddle 16*a* reciprocates along the X-axis direction by a non-illustrated X-axis drive mechanism. Each grindstone 16*c* is attached to the associated X-axis saddle 16*a* via a bearing section 16*b*, and grinds the workpiece W. Each drive mechanism 16*d* is attached to the associated X-axis saddle 16*a*, and includes a motor and a transmission belt for rotating the grindstone 16*c*. Each grindstone cover 16*e* is mounted on the associated X-axis saddle 16*a* and covers the entire rear portion of the grindstone 16*c* such that only the operating end at the front portion of the grindstone 16*c* is exposed.

As a ball screw 17 is rotated by a non-illustrated motor for Z-axis movement, the Z-axis saddles 14 are moved in the Z-axis direction and are arranged such that the grindstones 16*c* on the grinding heads 16 correspond to predetermined sections to be machined of the rotating workpiece W. In this state, the grinding heads 16 are moved in the direction to approach the workpiece W, that is, toward the front by a non-illustrated X-axis movement mechanism while the grindstones 16*c* are rotated by the drive mechanisms 16*d*. Accordingly, the grindstones 16*c* grind the sections to be machined of the workpiece W. In this case, a coolant is supplied to the sections to be machined of the workpiece W ground by the grindstones 16*c* through a non-illustrated coolant supplying device.

Figure 3:
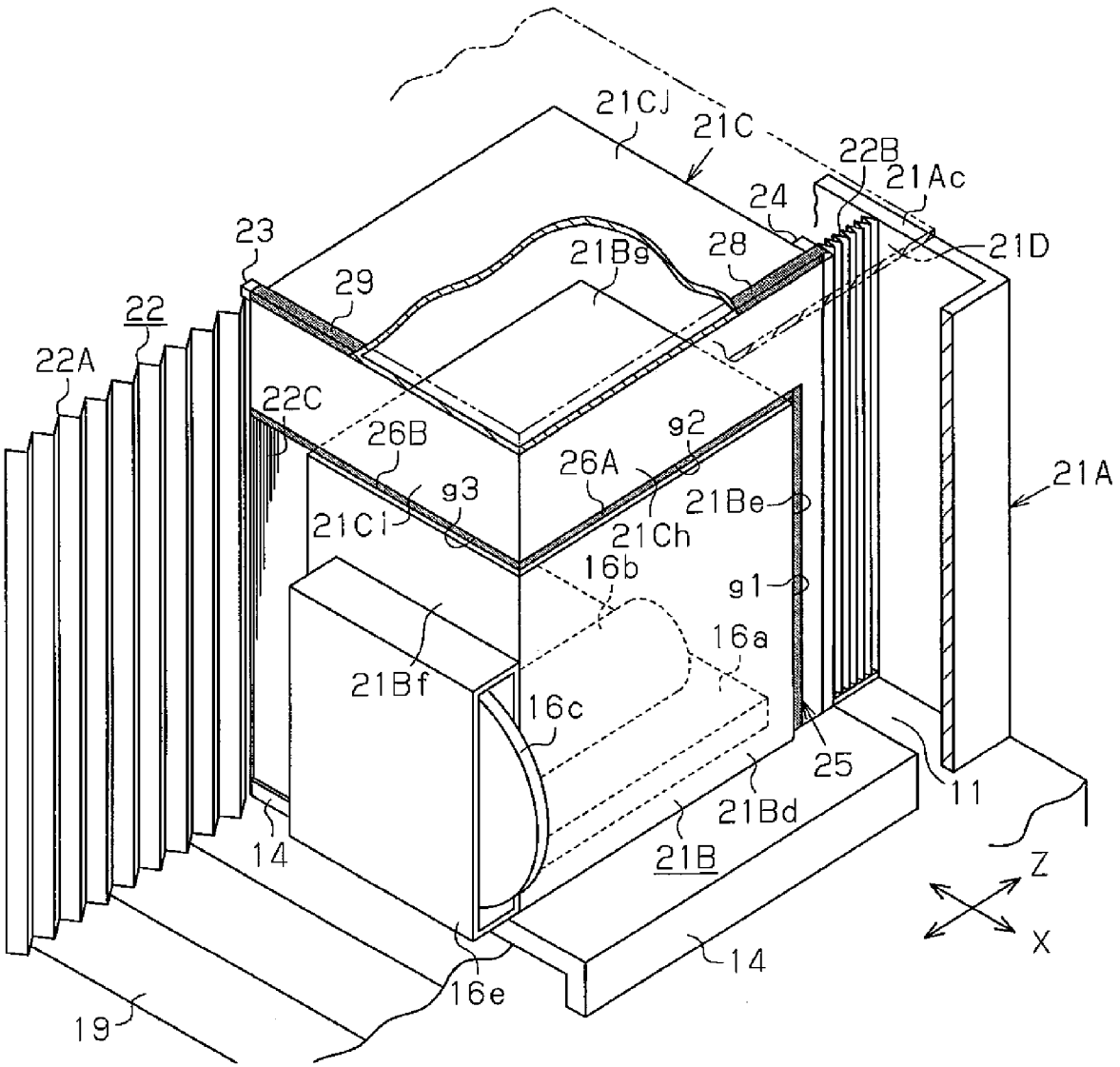
FIG. 3 is a perspective view of the essential part illustrating the grinding head on the right side in FIG. 1.

As shown in FIGS. 1 to 3, an extendable telescopic cover 19 for covering the upper surface of the bed 11 is arranged between the Z-axis saddles 14. Partitioning means, which is a partition structure 20 in this embodiment, for partitioning a machining region T to be sealed is arranged above the bed 11, the Z-axis saddles 14, the X-axis saddles 16*a*, and the telescopic cover 19. The partition structure 20 includes a fixed cover 21 (21A, 21B, 21C, 21D), which is fixed to the bed 11, the X-axis saddles 16*a*, and the Z-axis saddles 14, an extendable cover 22 (22A, 22B, 22C), which is selectively extended and contracted in accordance with the movement of the Z-axis saddles 14 and the X-axis saddles 16*a*. The clamping portions 12*a*, 13*a* of the workpiece support devices 12, 13 and the grindstones 16*c* of the grinding heads 16 are arranged in the machining region T partitioned by the fixed cover 21 and the extendable cover 22 of the partition structure 20. Also, the bearing sections 12*b*, 13*b* and the driving sections 12*c*, 13*c* of the workpiece support devices 12, 13, the bearing sections 16*b* of the grinding heads 16, and the drive mechanisms 16*d* are arranged outside the machining region T.

The structure of the fixed cover 21 and the extendable cover 22 will now be described.

As shown in FIGS. 1 to 3, the fixed cover 21 includes a pair of first fixed covers 21A, which is attached and orthogonal to the bed 11 corresponding to the workpiece support devices 12, 13, a pair of second fixed covers 21B, which is attached to the pair of X-axis saddles 16*a*, and a pair of third fixed covers 21C, which is attached to the Z-axis saddles 14 via a later described first and second support columns 23, 24. Also, the fixed cover 21 includes a fourth fixed cover 21D, which is fixed to the upper edges of the first fixed covers 21A by welding to shield the upper section of the machining region T. The fourth fixed cover 21D slidably contacts the upper surface of a horizontal shield portion 21Cj of the third fixed cover 21C, the upper end surface of the extendable cover 22, and the upper end surface of the support columns 23, 24.

Figure 4:
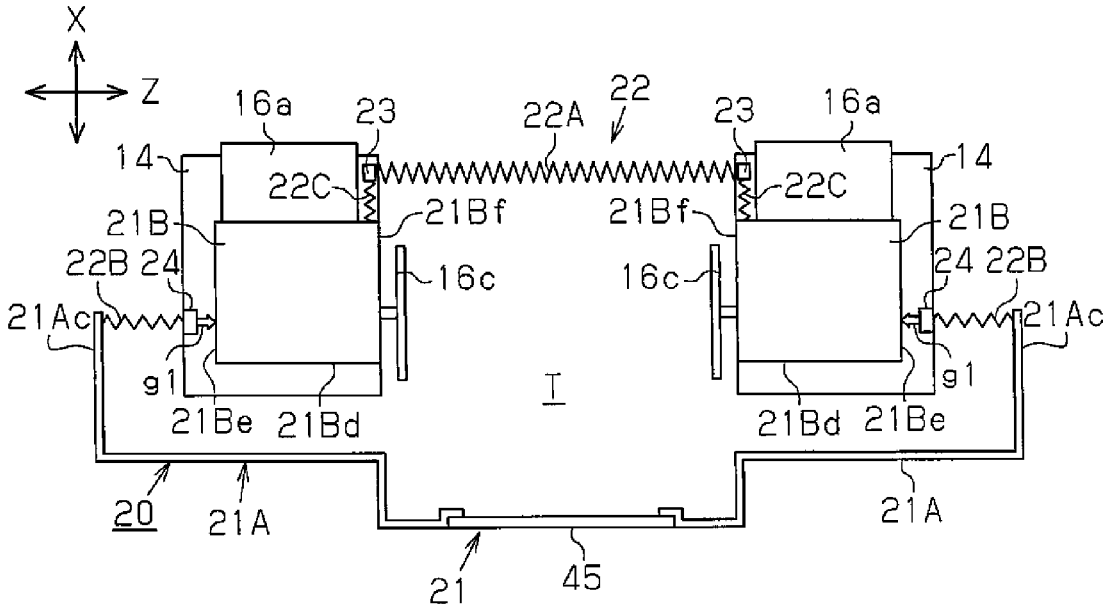
FIG. 4 is a cross-sectional plan view illustrating a simplified form of the partition structure.
Figure 5:
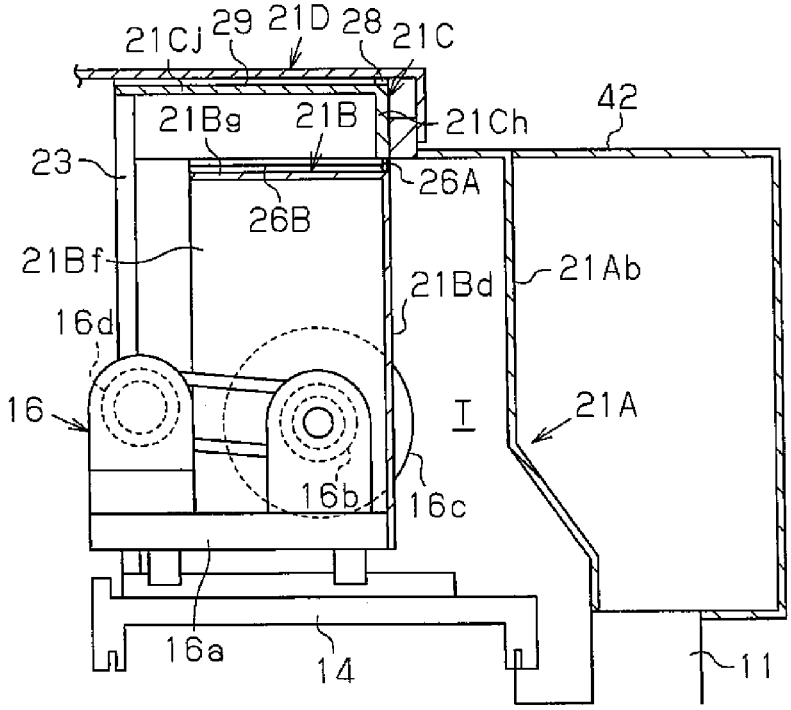
FIG. 5 is a longitudinal cross-sectional view illustrating a simplified form of the partition structure.

As shown in FIGS. 1 and 4, each first fixed cover 21A includes a shield portion 21Aa, a shield portion 21Ab, and a shield portion 21Ac formed by bending. The shield portions 21Aa form partitions between the clamping portions 12*a*, 13*a* and the bearing sections 12*b*, 13*b* of the workpiece support devices 12, 13. The shield portions 21Ab form partitions between the bearing sections 12*b*, 13*b* of the workpiece support devices 12, 13 and the grinding heads 16. The shield portions 21Ac partition the outward parts of the grinding heads 16 in the left and right direction.

As shown in FIGS. 1 to 3 and 5, the second fixed covers 21B attached to the X-axis saddles 16*a* cover the bearing sections 16*b* and part of the drive mechanisms 16*d* of the grinding heads 16. Each second fixed cover 21B includes a shield portion 21Bd, a shield portion 21Be, a shield portion 21Bf, and a horizontal shield portion 21Bg. Each shield portion 21Bd is located between the associated bearing section 16*b* and the shield portion 21Ab. Each shield portion 21Be shields the outer section of the associated bearing section 16*b* in the Z-axis direction. Each shield portion 21Bf shields between the associated bearing section 16*b* and the grindstone cover 16*e*. The horizontal shield portion 21Bg is formed by bending the upper edge of the shield portions 21Bd to 21Bf.

As shown in FIG. 1, a pair of first support columns 23 is formed on and orthogonal to on the rear inner portions of the upper surfaces of the Z-axis saddles 14. Also, a pair of second support columns 24 is formed on and orthogonal to the front outer portions of the upper surfaces of the Z-axis saddles 14. As shown in FIG. 3, a gap g1 is formed between each second support column 24 and the shield portion 21Be of the associated second fixed cover 21B. Each third fixed cover 21C is attached to the upper ends of the first and second support columns 23, 24 to shield the portion above the associated second fixed cover 21B. Each third fixed cover 21C faces the upper surface of the horizontal shield portion 21Bg of the associated second fixed cover 21B with a gap g2 formed in between, and includes a shield portion 21Ch that is parallel to the associated shield portion 21Bd. Also, each third fixed cover 21C faces the horizontal shield portion 21Bg and the upper edge of a later described third extendable cover 22C with a gap g3 formed in between, and includes a shield portion 21Ci located on the same vertical plane as the shield portion 21Bf. Furthermore, each third fixed cover 21C includes a horizontal shield portion 21Cj that is square in a plan view formed by bending the upper edge of the shield portions 21Ch, 21Ci.

A vertical sealing member 25 is fitted to each second support column 24 to close the gap g1. The vertical sealing member 25 functions as a wiper that slidably contacts the outer surface of the shield portion 21Be when the second fixed cover 21B moves in the X-axis direction. A first horizontal sealing member 26A is fitted to the lower edge of each shield portion 21Ch. The first horizontal sealing member 26A functions as a wiper that slidably contacts the upper surface of the horizontal shield portion 21Bg when the second fixed cover 21B moves in the X-axis direction. A second horizontal sealing member 26B is fitted to the lower edge of each shield portion 21Ci. The second horizontal sealing member 26B slidably contacts the upper surface of the horizontal shield portion 21Bg and the upper edge of the later described third extendable cover 22C when the second fixed cover 21B moves in the X-axis direction. The gaps g2, g3 are thus closed by the first and second horizontal sealing members 26A, 26B.

As shown in FIG. 3, a sealing member 28, which extends in the Z-axis direction, and a sealing member 29, which extends in the X-axis direction, are fitted to the upper surface of the horizontal shield portion 21Cj of each third fixed cover 21C. The sealing members 28, 29 contact the lower surface of the fourth fixed cover 21D, and seal the space between the associated third fixed cover 21C and the fourth fixed cover 21D.

The extendable cover 22 includes a first extendable cover 22A located between the pair of first support columns 23, and a pair of second extendable covers 22B located on both left and right sides of the bed 11, and a pair of third extendable covers 22C located in the vicinity of the first support columns 23 as shown in FIGS. 1 and 4. The first to third extendable covers 22A, 22B, 22C are formed of bellows covers. The first extendable cover 22A is coupled to the first support columns 23 to shield the space between the first support columns 23. The upper end and the lower end of the first extendable cover 22A are guided and moved in the Z-axis direction by an upper Z-axis guide mechanism 27A and a lower Z-axis guide mechanism 27B, which are of curtain guide rail type, as shown in FIG. 2. The lower edge of the first extendable cover 22A is slightly separate from the upper surface of the telescopic cover 19. The lower end of the first extendable cover 22A contacts the front surface of a bump 19*a* formed at the rear end of the telescopic cover 19 to protrude upward. The upper Z-axis guide mechanism 27A and the lower Z-axis guide mechanism 27B prevent the first extendable cover 22A from moving forward.

Each second extendable cover 22B is coupled to the associated shield portion 21Ac and the associated second support column 24 to shield the space between the rear edge of the shield portion 21Ac of the first fixed cover 21A and the second support column 24 as shown in FIGS. 1 and 4. The lower edge of each second extendable cover 22B is slightly separate from the upper surface of the bed 11 as shown in FIG.

3, and the upper edge of each second extendable cover 22B is guided and moved in the Z-axis direction by a non-illustrated Z-axis guide mechanism.

Each third extendable cover 22C is coupled to the associated first support column 23 and the rear edge of the shield portion 21Bf to shield the space between the rear edge of the shield portion 21Bf of the associated second fixed cover 21B and the first support column 23 as shown in FIGS. 1 and 4. The upper edge of each third extendable cover 22C is guided and moved in the X-axis direction by a non-illustrated X-axis guide mechanism. The lower edge of each third extendable cover 22C is slightly separate from the upper surface of the associated Z-axis saddle 14 as shown in FIG. 2.

As shown in FIGS. 1 and 2, related components including, for example, a terminal case 41 for electrical wiring, are mounted at the rear of the grinding heads 16 on the upper surface of the bed 11. A front outer cover 42 is fitted to the front upper portion of the bed 11. As shown in FIGS. 1 and 2, a rear cover 43, which covers, for example, the grinding heads 16 and the terminal case 41, is attached to the upper surface of the bed 11. An opening portion 44 for putting the workpiece W in and out of the machining region T is formed in the front surface of the front outer cover 42, and a door 45 is attached to the opening portion 44 to be selectively opened and closed. The door 45 is also a component forming the partition structure 20.

The cover structure of the grinding machine formed as described above will now be described.

Figure 6:
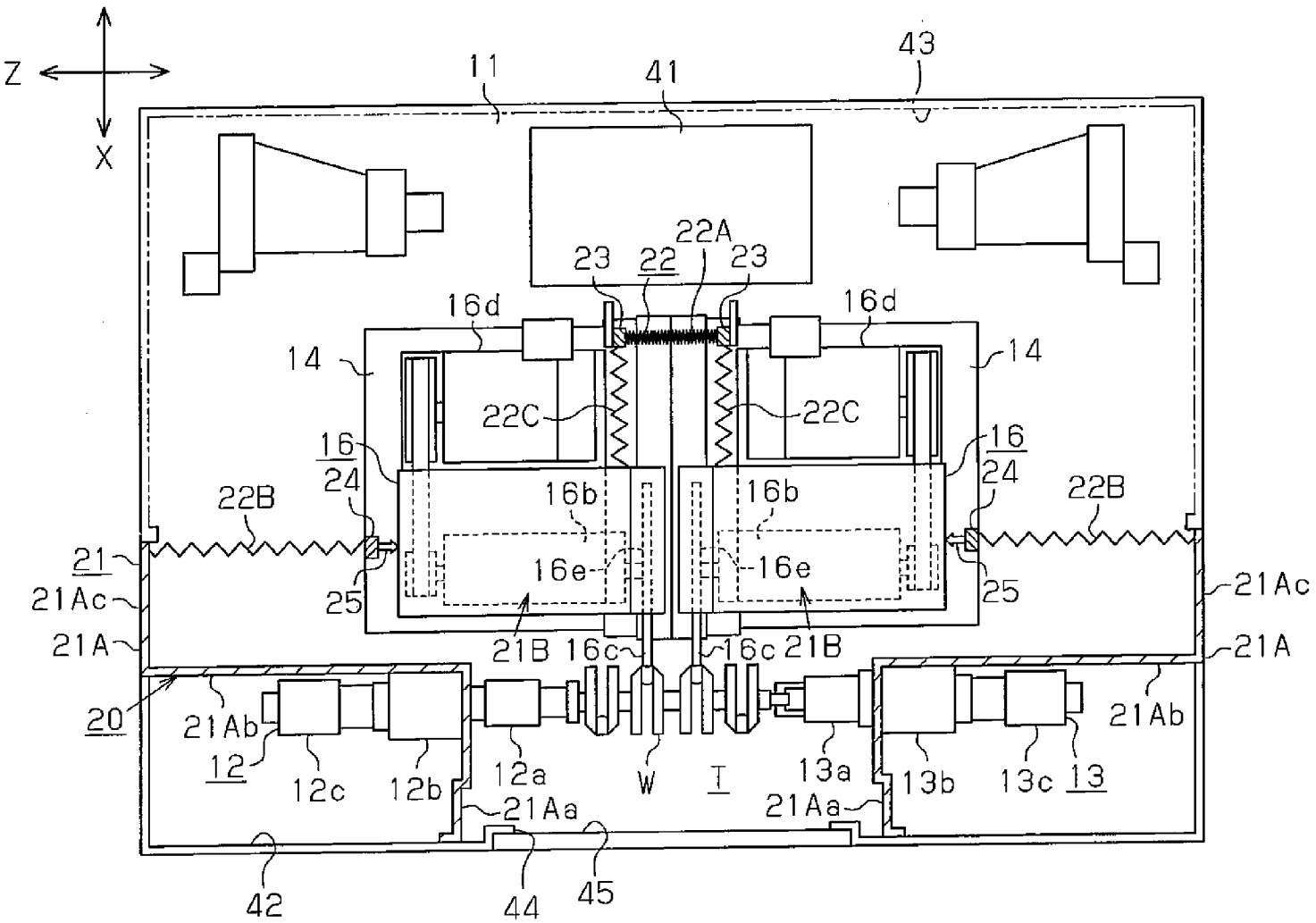
FIG. 6 is a cross-sectional view illustrating the grinding machine showing the state in which a pair of left and right grinding heads is arranged closest to each other.

During grinding of the grinding machine, the Z-axis saddles 14 are moved to arbitrary positions between a separate position shown in FIG. 1 and a close position shown in FIG. 6.

Then, the grindstones 16*c* of the grinding heads 16 are arranged at positions corresponding to the predetermined sections to be machined of the workpiece W located between the workpiece support devices 12, 13. At this time, as shown in FIGS. 1 and 6, the first extendable cover 22A and the second extendable covers 22B of the partition structure 20 are extended or contracted in accordance with the movement of the Z-axis saddles 14, thus permitting the Z-axis saddles 14 to move.

In a state where the grindstones 16*c* are arranged to correspond to the predetermined sections to be machined of the workpiece W, the grinding heads 16 are moved in the X-axis direction toward the workpiece W while the workpiece W and the grindstones 16*c* are rotated. Thus, the grindstones 16*c* grind the sections to be machined of the workpiece W. At this time, the third extendable covers 22C of the partition structure 20 are extended in accordance with the movement of the grinding heads 16, thus permitting the movement of the grinding heads 16. The grindstones 16*c* grind the workpiece W inside the machining region T sealed by the partition structure 20 formed of the fixed cover 21 and the extendable cover 22. Therefore, coolant including swarf supplied to the sections to be machined of the workpiece W is prevented from scattering to the outside from the machining region T.

Thus, the present embodiment has the following advantages.

(1) The clamping portions 12*a*, 13*a* of the workpiece support devices 12, 13 and the grindstones 16*c* of the grinding heads 16 are located inside the machining region T. The partition structure 20 for partitioning the machining region T to be sealed is provided such that the bearing sections 12*b*, 13*b* of the workpiece support devices 12, 13, the bearing sections 16*b* of the grinding heads 16, and the drive mechanisms 16*d* are located outside the machining region T. Thus, only the machining region T including the grindstones 16*c* of the grinding heads 16 is blocked by the partition structure 20. Thus, during grinding of the workpiece W, coolant and coolant mist are prevented from scattering from the inside of the machining region T to the surrounding area of the machining region T. This prevents a trouble from occurring during grinding operation by adhesion of coolant to the bearing sections 16*b* and the drive mechanisms 16*d* of the grinding heads 16.

(2) The partition structure 20 is formed of the fixed cover 21, which is fixed on the bed 11, the Z-axis saddles 14, and the X-axis saddles 16*a*, and the extendable cover 22, which is extended and contracted in accordance with the movement of the Z-axis saddles 14 and the X-axis saddles 16*a*, so as not to interfere with the Z-axis saddles 14 and the X-axis saddles 16*a*. Therefore, the partition structure 20, which partitions the machining region T, is easily formed by the fixed cover 21 and the extendable cover 22.

(3) The pair of first fixed covers 21A is formed on and orthogonal to the bed 11 and shields between the clamping portions 12*a*, 13*a* and the bearing sections 12*b*, 13*b* of the workpiece support devices 12, 13, between the bearing sections 12*b*, 13*b* of the workpiece support devices 12, 13 and the bearing sections 16*b* of the grinding heads 16, and the outer sections of the bearing sections 16*b* of the grinding heads 16. Also, the first and second support columns 23, 24 are formed on and orthogonal to the upper surfaces of the Z-axis saddles 14. The first extendable cover 22A is provided between the pair of first support columns 23. Each second extendable cover 22B is provided between the associated second support column 24 and the shield portion 21Ac. Each third extendable cover 22C is provided between the associated first support column 23 and the second fixed cover 21B. Therefore, the machining region T is shielded in the minimum required area.

(4) As shown in FIG. 4, the pair of first support columns 23 is formed on and orthogonal to the rear upper surfaces of the left and right pair of Z-axis saddles 14. The first extendable cover 22A is attached to the first support columns 23. Therefore, the first extendable cover 22A is arranged at the rear of the grindstones 16*c* as shown in FIG. 6. Thus, even in a state where the left and right pair of grindstones 16*c* are arranged closest to each other, a space is obtained that can easily accommodate the contracted first extendable cover 22A in the gap between the first support columns 23. If the first extendable cover 22A is located between the left and right pair of the grindstone covers 16*e*, which project inward from the side surfaces of the Z-axis saddles, the distance between the grindstones 16*c* when the grindstones 16*c* are brought closest to each other becomes undesirably long due to the restriction of the minimum contraction dimension of the first extendable cover 22A. Thus, two sections to be machined at the minimum distance cannot be simultaneously machined. Also, in the grinding machine, contamination of the first extendable cover 22A by the scattered coolant is reduced since the first extendable cover 22A is provided at a position spaced rearward from the sections to be machined close to the grindstones 16*c*.

(5) As shown in FIG. 3, each second fixed cover 21B is attached to the associated X-axis saddle 16*a*, and each third fixed cover 21C is attached to the upper surface of the associated Z-axis saddle 14 via the first and second support columns 23, 24. Therefore, the size and the weight of each second fixed cover 21B are reduced, and each grinding head 16 is smoothly moved in the X-axis direction.

(6) The extendable cover 22 is formed of the first extendable cover 22A, which shields between the first support columns 23, the pair of second extendable covers 22B, each of which shielding between the associated second support column 24 and the shield portion 21Ac of the associated first fixed cover 21A, and the pair of third extendable covers 22C, each of which shielding between the associated first support column 23 and the rear edge of the shield portion 21Bf of the associated second fixed cover 21B. Therefore, the extendable cover 22 of the partition structure 20 is easily formed by the first to third extendable covers 22A to 22C.

(7) Since the first to third extendable covers 22A to 22C are formed of bellows covers, the first to third extendable covers 22A to 22C are easily and inexpensively formed.

(8) The vertical sealing member 25, which slidably contacts the outer surface of the shield portion 21Be, is provided between the shield portion 21Be of each second fixed cover 21B and the associated second support column 24. Therefore, the gaps g1 are reliably closed by the vertical sealing members 25, and coolant is prevented from leaking through the gaps g1.

(9) The first and second horizontal sealing members 26A, 26B shield the gaps g2, g3 between the shield portions 21Ch, 21Ci of each third fixed cover 21C with respect to the horizontal shield portion 21Bg of the associated second fixed cover 21B and the associated third extendable cover 22C.

Therefore, since the gaps g2, g3 are closed by the first and second horizontal sealing members 26A, 26B, coolant is prevented from leaking through the gaps g2, g3.

(10) The first to third extendable covers 22A to 22C are operated only in the extending and contracting direction. Thus, the covers 22A to 22C are smoothly operated in the grinding machine having the grinding heads 16 with a great stroke in the left and right direction and the front and rear direction.

(Modifications)

The present embodiment may be modified as follows.

Figure 7:
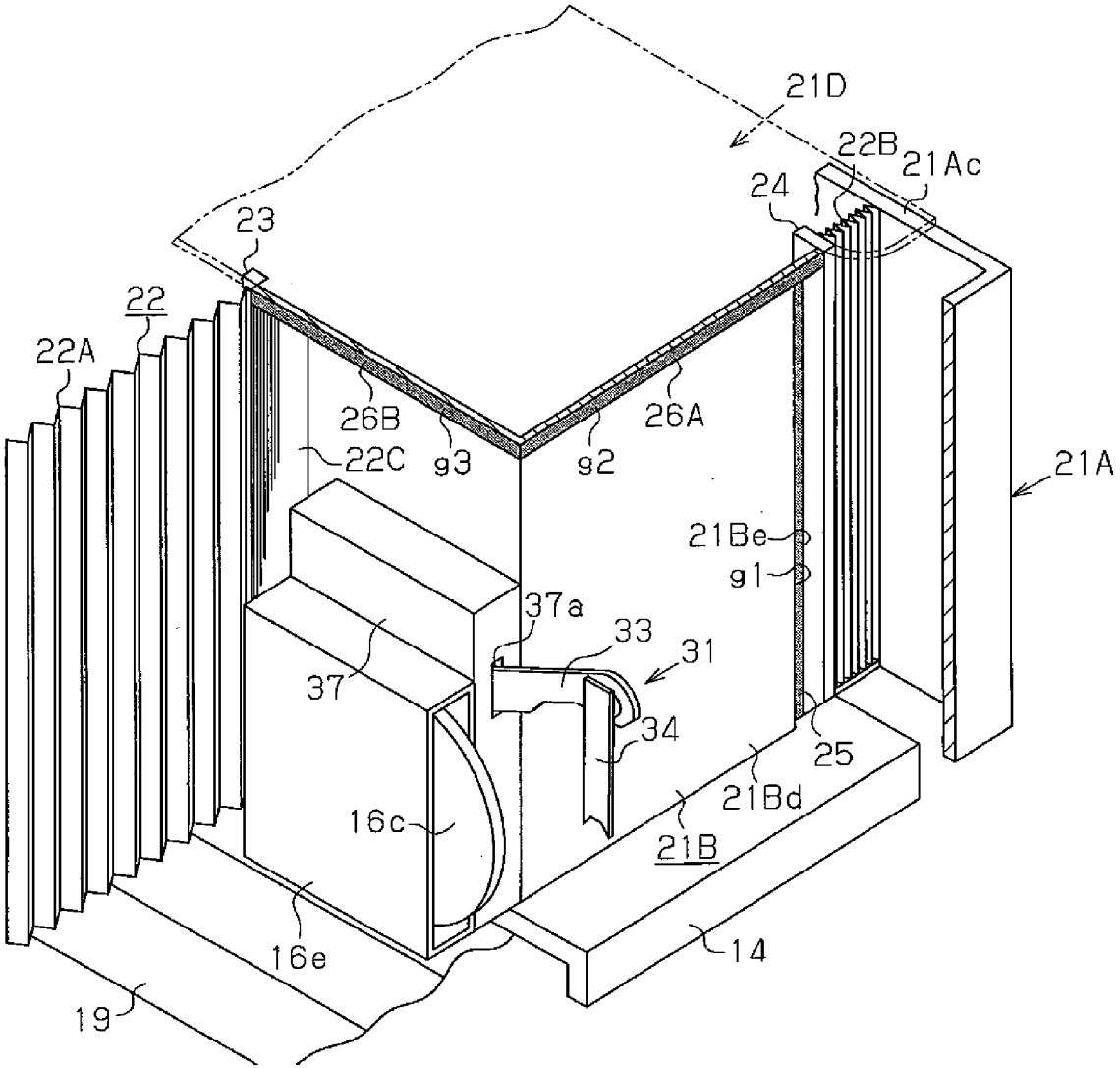
FIG. 7 is a partial perspective view illustrating a grinding machine according to another embodiment of the present invention.

As shown in FIG. 7, the third fixed covers 21C may be omitted, and the second fixed covers 21B, the third extendable covers 22C, and the vertical sealing members 25 may be extended upward. The first and second horizontal sealing members 26A, 26B provided on the upper surface of each second fixed cover 21B contact the lower surface of the fourth fixed cover 21D. In the present embodiment, the number of the components of the fixed cover 21 can be reduced since the third fixed cover 21C may be omitted.

Figure 8:
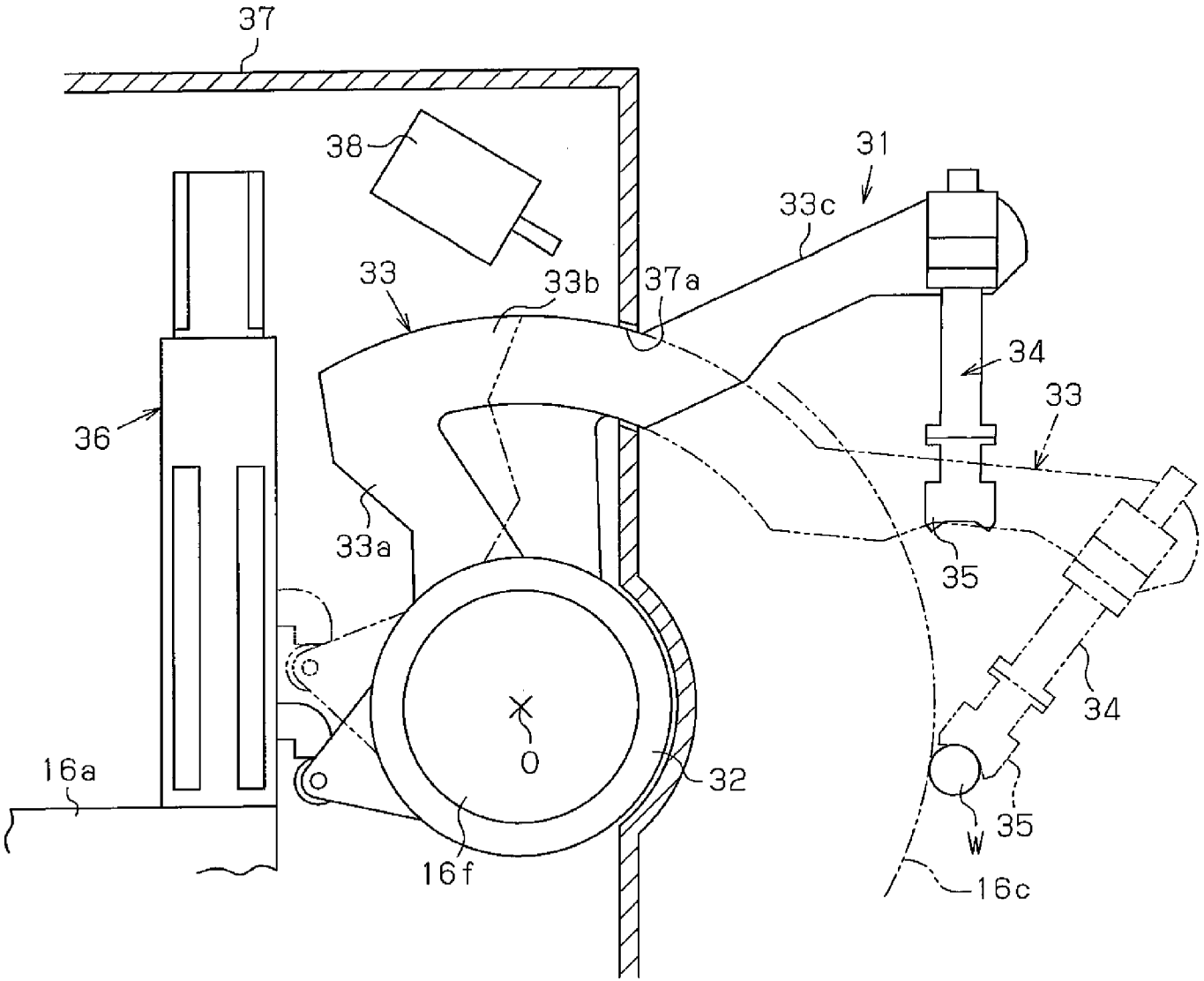
FIG. 8 is a cross-sectional side view illustrating a pin diameter measuring device that measures the diameter of a pin of a workpiece on a grinding machine shown in FIG. 7.

As shown in FIGS. 7 and 8, a pin diameter measuring device 31 for measuring the diameter of the workpiece W (crank pin) ground by each grindstone 16*c* may be provided in the vicinity of the associated grindstone cover 16*e*. The driving section of each pin diameter measuring device 31 is covered by a separate cover 37. The pin diameter measuring device 31 will now be described.

A support ring 32 is rotatably supported on the outer surface of the shield portion 21Bf to be located on the outer circumference of a rotary shaft 16*f*, and a support arm 33 is coupled to the support ring 32. The support arm 33 includes a first straight portion 33*a* coupled to the support ring 32, an arcuate portion 33*b*, which is integrally coupled to the first straight portion 33*a* and has an arcuate shape that is coaxial with and has a greater radius than the support ring 32, and a second straight portion 33*c*, which is integrally formed with the arcuate portion 33*b* as to be bent from the arcuate portion 33*b*. A measuring arm 34 is pivotally coupled to the distal end of the second straight portion 33*c*. A contact 35 for contacting the outer circumferential surface of the pin of the workpiece W (crank pin) and measuring the diameter is provided on the distal end of the measuring arm 34. The support arm 33 is tilted about the center O of the rotary shaft 16*f*.

A drive mechanism 36 for tilting the support arm 33 is provided on each X-axis saddle 16*a*. A cover 37 for shielding the support ring 32, the first straight portion 33*a* of the support arm 33, and the drive mechanism 36 is provided on each X-axis saddle 16*a* to be located between the grindstone cover 16*e* and the shield portion 21Bf. A window hole 37*a* is formed in the front surface of each cover 37. The size of the window hole 37*a* is set such that the window hole 37*a* is inserted through the arcuate portion 33*b* with a slight gap around the arcuate portion just enough not to contact the arcuate portion 33*b*. A blower fan 38 is provided inside each cover 37. The blower fan 38 blows air to the window hole 37*a* to prevent coolant from entering the cover 37 through a small gap around the arcuate portion 33*b* during grinding operation of the workpiece W.

As described above, the support ring 32 is attached to the rotary shaft 16*f*, and the support arm 33 is attached to the support ring 32 as shown in FIG. 8. Also, the cover 37 having the window hole 37*a*, which is inserted through the arcuate portion 33*b* of the support arm 33, and the blower fan 38 are provided. Thus, while covering the drive mechanism 36 of the pin diameter measuring device 31 with the cover 37, the support arm 33 can be advanced or retracted from the minimum required window hole 37*a*. Furthermore, an air curtain generated by the blower fan 38 reliably protects the pin diameter measuring device 31 from coolant and coolant mist.

The rotary shaft of the motor of each drive mechanism 16*d* may directly rotate the associated grindstone 16*c*. In this case, since the motor is arranged at the position of the bearing section 16*b*, the motor itself also functions as the bearing section of the grindstone 16*c*.

The present invention may be embodied in a grinding apparatus that grinds a journal portion of a crank pin.

The first to third extendable covers 22A to 22C may be telescopic covers or wind-up covers. Also, the first to third extendable covers 22A to 22C may be changed to extendable covers that can be switched between an open state, in which strap-like cover pieces are arranged in layers, and a closed state, in which the cover pieces are coupled to each other on the side edges.

In each of the embodiments, the configuration of the partition structure 20 serving as the partitioning means may be changed as required.

The pin diameter measuring device 31 according to the embodiment shown in FIGS. 7 and 8 may be stored in each second fixed cover 21B, and only the distal end of each support arm 33 may be arranged in the machining region T. A measuring device of another configuration may also be used.

The invention claimed is:

1. A grinding machine that grinds a workpiece in a machining region, the workpiece having ends, the grinding machine comprising:

a bed;

a pair of workpiece support devices located on the bed, each workpiece support device including a clamping portion, a bearing section, and a driving section, and the pair of workpiece support devices rotates the workpiece about a horizontal axis in a state where the workpiece is clamped by the clamping portions on both ends of the workpiece;

a pair of first saddles movable in a first direction, which extends along a rotation axis of the workpiece;

a pair of second saddles respectively attached to the pair of first saddles, the second saddles being movable in a second direction, which is orthogonal to the first direction; and a pair of grinding heads respectively located on the pair of second saddles, each grinding head including a grindstone, a bearing section, and a drive mechanism, the grinding machine being characterized by partitioning means for partitioning the machining region to be sealed such that the clamping portions of the pair of workpiece support devices and the grindstones of the pair of grinding heads are arranged inside the machining region, and the bearing sections and the driving sections of the pair of workpiece support devices and the bearing sections and the drive mechanisms of the pair of grinding heads are arranged outside the machining region, wherein the partitioning means includes:

a fixed cover fixed to the bed; and extendable covers attached, respectively, between the fixed cover and the pair of first saddles, between the first saddles and the second saddles, and between the pair of first saddles, and the extendable covers selectively extending and contracting in accordance with the movement of the pair of first saddles and the pair of second saddles.

2. The grinding machine according to claim 1, characterized in that the fixed cover includes:

a pair of first fixed covers formed on and orthogonal to the bed, each first fixed cover shielding between the clamping portion and the bearing section of the corresponding workpiece support device, between the bearing section of the corresponding workpiece support device and the corresponding grinding head, and an outward part of the corresponding grinding head in the first direction; and a pair of second fixed covers fixed on the second saddles, each second fixed cover shielding the bearing section and the drive mechanism of the corresponding grindstone from the grindstone.

3. The grinding machine according to claim 2, characterized by:

a pair of first support columns each formed on and orthogonal to a rear upper surface of one of the first saddles; and a pair of second support columns each formed on and orthogonal to an upper surface of one of the first saddles, the extendable covers including:

a first extendable cover, which shields between the pair of first support columns;

a pair of second extendable covers each shielding between a shield portion of one of the first fixed cover on an outer section in the first direction and the corresponding one of second support columns; and a pair of third extendable covers each shielding between one of first support columns and a rear edge of the corresponding second fixed cover.

4. The grinding machine according to claim 3, characterized in that the first to third extendable covers are formed of bellows covers.

5. The grinding machine according to claim 3, characterized in that a gap is formed between each second support column and a shield portion of the corresponding second fixed cover on the outer section in the first direction, wherein each second support column is provided with a sealing member, the sealing member shielding the corresponding gap and slidably contacting the outer surface of the associated shield portion.

6. The grinding machine according to claim 3, characterized in that a third fixed cover is attached to the associated first and second support columns to be located above each of the pair of second fixed covers, each third fixed cover being provided with first and second horizontal sealing members, the first and second horizontal sealing members shielding a gap between each second fixed cover and the associated third fixed cover, the first and second horizontal sealing members can slidably contact the upper surface of a horizontal shield portion of the associated second fixed cover, and a fourth fixed cover is attached to an upper edge of each of the first fixed covers, upper edges of the first to third extendable covers, and an upper surface of the corresponding third fixed cover, the fourth fixed cover shielding an upper space of the machining region.

* * * * *